United States Patent [19]

von Harz

[11] 4,362,350

[45] Dec. 7, 1982

[54] CONTACT RETENTION ASSEMBLY

[75] Inventor: James L. von Harz, South Laguna, Calif.

[73] Assignee: International Telephone and Telegraph Corporation, New York, N.Y.

[21] Appl. No.: 157,978

[22] Filed: Jun. 9, 1980

[51] Int. Cl.[3] ..... H01R 13/648

[52] U.S. Cl. ..... 339/143 R; 339/217 R

[58] Field of Search ..... 339/143 R, 217 R, 217 S, 339/182, 183; 333/195

[56] References Cited

U.S. PATENT DOCUMENTS

| | | | |
|---|---|---|---|
| 3,172,721 | 3/1965 | Kelly | 339/217 S |
| 3,327,282 | 6/1967 | Krolak | 339/217 S X |
| 3,462,715 | 8/1969 | Schor | 333/79 |
| 3,500,298 | 3/1970 | Williamson et al. | 339/217 |
| 3,544,954 | 1/1970 | Yeager | 339/217 |
| 3,629,785 | 12/1979 | Cowmeadow | 339/14 R |
| 3,631,375 | 12/1971 | Bridle | 339/217 S X |
| 3,646,495 | 2/1972 | Cowmeadow | 339/14 R |
| 3,670,292 | 6/1972 | Tracy | 339/143 R |
| 3,673,541 | 6/1972 | Volinskie | 339/16 R |
| 3,721,869 | 3/1973 | Paoli | 317/256 |
| 3,743,979 | 7/1973 | Schor | 333/79 |
| 3,790,858 | 2/1974 | Brancaleone et al. | 317/99 |
| 3,794,959 | 2/1974 | Kamolz | 339/103 M |
| 4,020,430 | 4/1977 | Heyden | 333/79 |
| 4,029,386 | 6/1977 | Krantz et al. | 339/143 R |
| 4,082,398 | 4/1978 | Bourdon et al. | 339/59 M |
| 4,126,370 | 11/1978 | Nitman | 339/143 R |

*Primary Examiner*—Eugene F. Desmond

*Attorney, Agent, or Firm*—Thomas L. Peterson

[57] ABSTRACT

An electrical connector is disclosed in which the insulator thereof contains a plurality of contact passages. A contact retention plate extends transversely across the insulator between its front and rear faces. The plate embodies apertures aligned with the contact passages. Contact retention fingers extend inwardly from the edges of the apertures to engage shoulders on insulative sleeves mounted on the contacts in the passages. The insulative sleeves provide a higher degree of contact-to-contact electrical isolation and, therefore, permit high density contact arrangements.

21 Claims, 9 Drawing Figures

CONTACT RETENTION ASSEMBLY

BACKGROUND OF THE INVENTION

The present invention relates generally to an electrical connector and, more particularly, to a contact retention assembly for an electrical connector.

Metal contact retention clips are commonly utilized in the electrical connector art for releasably retaining electrical contacts in the insulators of electrical connectors. For example, U.S. Pat. No. 3,158,424 to Bowen discloses the use of a metal contact retention clip having forwardly and inwardly extending retention fingers which engage a shoulder on a contact to retain the contact which is inserted into the insulator from the rear. In order to remove the contact from the insulator, a special tool is inserted into the contact passage from the rear which deflects the retention fingers outwardly beyond the shoulder on the contact thereby releasing the contact.

U.S. Pat. No. 3,246,281 to Cunningham discloses another form of contact retention assembly in which the contact is released from the front rather than the rear of the insulator. In this arrangement, a contact retention clip mounted in the contact passage embodies forwardly extending spring fingers each formed with an internal shoulder which engages a rearwardly facing shoulder on the contact. The forward end of each finger has an internal bevel which extends over the contact in front of the shoulder thereon. The contact may be removed rearwardly from the insulator by inserting a tool into the contact passage from the front of the insulator to engage the beveled surfaces on the fingers, thereby deflecting them radially outwardly from engagement with the shoulder on the contact. Other forms of contact retention clips for either front or rear release of the contacts are well known in the art.

High density contact arrangements in prior art connectors employing contact retention clips as described above are limited because the relatively thin walls of plastic between the contact passages are inadequate to provide the necessary degree of contact-to-contact electrical isolation required to avoid voltage breakdown between the contacts and surface leakage of current from contact to contact. It is, therefore, one object of the present invention to provide a novel contact retention assembly which will permit higher density contact arrangements without impairing electrical isolation between the contacts in the assembly.

The prior art contact retention assemblies utilizing metal retention clips are relatively expensive because of the necessity to assemble a large number of individual clips into the connector insulator. Also, special manufacturing techniques are often required to assure that the clips are retained in the contact passages. Another object of the present invention is to avoid the foregoing assembly problems, as well as the voltage breakdown problems discussed above.

The problem of electrical isolation between the contacts in an electrical connector was addressed in U.S. Pat. No. 2,443,513 to Quackenbush. In this patent, each contact is formed with a pair of axially spaced enlargements providing outwardly facing shoulders. The contact is mounted between front and rear insulators having abutment surfaces thereon which engage the outwardly facing shoulders on the contact to retain the contact in the insulator assembly. In order to raise the permissible voltage between the contacts and to reduce surface leakage of current from contact to contact, an enamel insulating band is provided in the form of a coating over the contact in the region of the two enlargements thereon which is aligned with the interface between the front and rear insulators of the assembly. However, the Quackenbush connector does not employ contact retention clips which would allow individual contacts to be removed from the insulator assembly without removing one of the insulators. Thus, the Quackenbush arrangement is impractical for many applications and does not provide a solution to the problem of providing a high degree of contact-to-contact electrical isolation in an electrical connector employing individual contact retention clips which releasably mount the contacts in the insulator.

SUMMARY OF THE INVENTION

According to a principal aspect of the present invention, there is provided an electrical connector member comprising an insulator having a plurality of passages extending therethrough from a front face to a rear face thereof. A contact retention plate extends transversely across the insulator substantially normal to the longitudinal axes of the passages. The plate embodies apertures aligned with the passages. A radially deflectable retention finger extends inwardly from the edge of each aperture into its corresponding passage toward one of the faces of the insulator. A contact is mounted in at least one of the passages. The contact has an insulative sleeve thereon formed with a shoulder directed toward the other of the faces of the insulator. The shoulder is engaged by the finger on the contact retention plate whereby the finger restricts movement of the contact in the direction of the other face of the insulator.

With the foregoing arrangement, the insulative sleeves on contacts mounted in the passages in the insulator provide the necessary degree of contact-to-contact electrical isolation to permit high density contact arrangements. Furthermore, a single contact retention plate replaces the plurality of individual contact retention clips required in prior art connectors for releasably retaining the contacts in the passages in the insulator. Other aspects and advantages of the invention will become more apparent from the following description taken in connection with the accompanying drawings.

DESCRIPTION OF THE PREFERRED EMBODIMENTS

Figure 1:
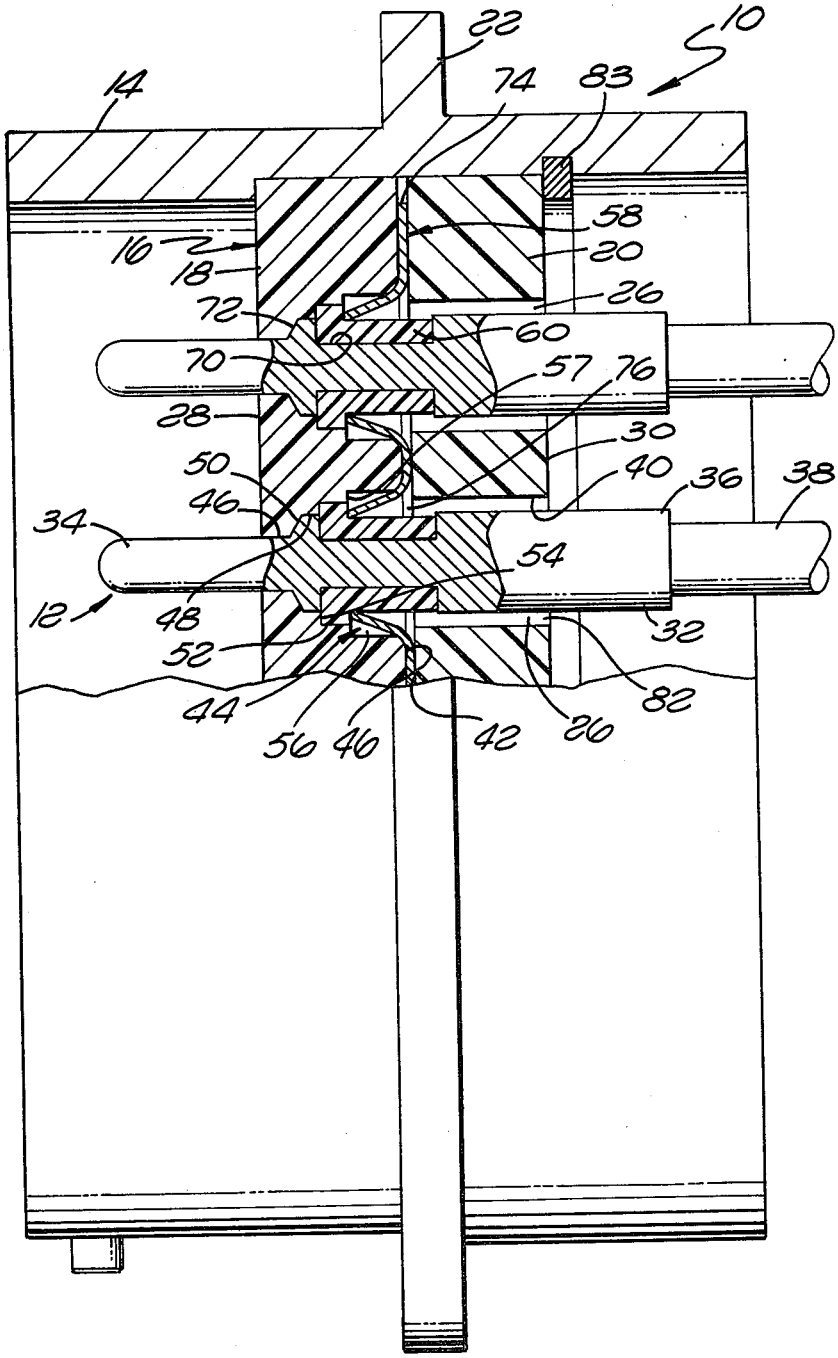
FIG. 1 is a partial longitudinal sectional view through an electrical connector embodying one form of the contact retention assembly of the present invention.
Figure 2:
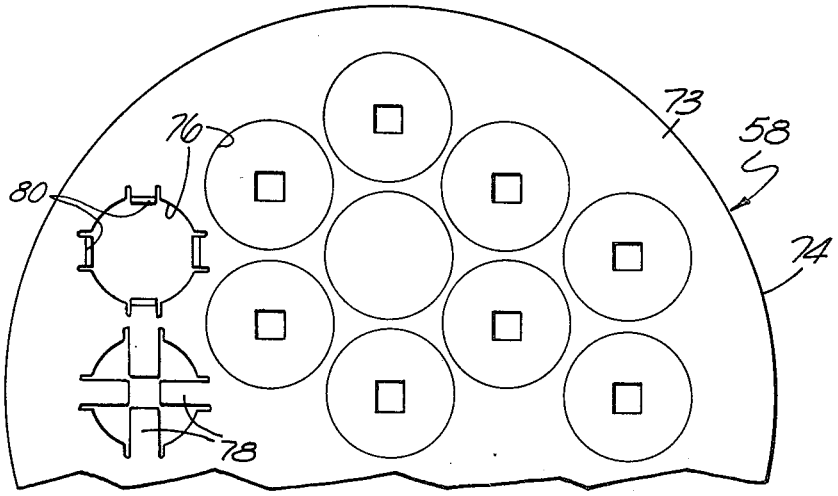
FIG. 2 is a fragmentary plan view of the contact retention plate utilized in the assembly illustrated in FIG. 1, showing two stages of the formation of the contact retention fingers in the plate.
Figure 3:
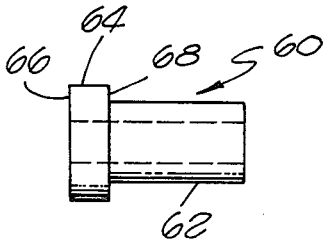
FIG. 3 is a side elevational view of the insulation sleeve utilized on the contacts shown in FIG. 1.

Referring now to the drawings in detail, wherein like reference characters designate like or corresponding parts throughout the various views, there is illustrated in FIGS. 1–3 one embodiment of the connector member of the present invention, generally designated 10. The connector member 10 is shown as a receptacle connector member containing a plurality of pin contacts 12. Alternatively, the contacts 12 could be socket contacts, or the connector member could be in the form of a plug connector containing either socket or pin contacts, depending upon the form of the contacts in the mating connector member.

The connector member 10 comprises a metal shell 14 containing an insulator assembly 16 consisting of a front insulator 18 and a rear insulator 20. The shell 14 is formed with a mounting flange 22 which may be secured to a rigid structure by means of a bolt (not shown) passing through a hole in the flange, such as indicated at 24 in FIG. 9. In the embodiments illustrated in the drawings, the connector member has a circular configuration. Alternatively, the connector could have a rectangular or "D" configuration.

The insulator assembly 16 is formed with a plurality of contact passages 26 extending from the front face 28 of the front insulator 18 to the rear face 30 of the rear insulator 20. Two of such passages are shown by way of example only in FIG. 1. The contacts 12 mounted in the passages 26 each comprises an elongated body 32 having a forward mating end 34 and a rear termination end 36. The forward mating end 34 is in the form of a solid pin adapted to engage a socket contact in a mating connector member. The rear termination end of the contact may be in the form of a barrel crimped to a conductor 38 extending outwardly from the rear of the shell 14.

Each contact passage 26 is formed by a cylindrical bore 40 extending from the front face 42 to the rear face 30 of the rear insulator, and a second bore, generally designated 44, extending from the rear face 46 of the front insulator to the front face 28 thereof. The bore 44 consists of a first section 46 opening at the front face 28 and having a diameter slightly greater than that of the forward mating end 34 of the contact. The first section 46 of bore 44 is joined to a second larger diameter section 48 by a tapered shoulder 50. The second section 48 of the bore is joined to a third larger diameter section 52 thereof by a radially extending annular abutment face 54. The third section 52 of the bore is joined to a fourth section 56 of still greater diameter by an annular shoulder 57, the rear section opening at the rear face of the front insulator. The diameter of the rear section 56 of bore 44 is slightly greater than the diameter of the bore 40 in the rear insulator.

In accordance with the invention, there is provided a single contact retention plate, generally designated 58, which is sandwiched between the front and rear insulators of the connector, and insulative sleeves or bushings 60 are mounted on the contacts 12 to electrically isolate the contacts from the plate 58, assuming the latter is formed of metal, and to increase contact-to-contact electrical isolation.

As best seen in FIG. 3, the bushing 60 comprises a hollow cylindrical body 62 formed with an enlargement 64 at its forward end providing a radially extending forwardly facing annular shoulder 66 and a radially extending rearwardly facing annular shoulder 68. The bushing 60 is mounted in an annular groove 70 in the contact body 32 spaced a short distance behind a tapered forwardly facing shoulder 72 on the body which leads down to the forward mating end 34 of the contact. The outside diameter of the body 62 of bushing 60 is approximately the same as the diameter of the body 32 of the contact 12. The diameter of the enlargement 64 on the bushing is greater than the diameter of the body 32 of the contact so that the shoulder 66 on the bushing extends outwardly of the contact body. The axial length of the groove 70 in the contact body is just slightly more than the length of the bushing 60 so that the bushing will fit firmly in the groove, thereby being restricted against axial movement on the contact body. The outer diameter of the enlargement 64 is slightly less than the diameter of the section 52 of bore 44 in the front insulator so that the forward portion of the bushing will be slidably received in that section of the bore when the contact is mounted in the contact passage 26.

The bushing may be formed of a suitable dielectric material, such as high strength plastic or epoxy. If the plastic material is irradiated, it may be initially constructed to have an internal diameter greater than the diameter of the body 32 of the contact. The bushing could then be slipped over the contact and heated to heat shrink the bushing down into the groove 70. Alternatively, the bushing 60 could be injection molded in the groove of the contact, or it could be longitudinally split, snapped over the contact with the seam of the bushing cemented thereafter to eliminate any electrical creepage path through the bushing. As a further alternative, the contact could be formed of front and rear parts which are assembled together with the bushing therebetween to mechanically entrap the bushing on the contact body.

The contact retention plate 58 may be similar to a ground plane commonly utilized in filter connectors, such as disclosed in U.S. Pat. No. 3,825,874 to Peverill and U.S. Pat. No. 4,020,430 to Heyden. Preferably, the plate comprises a resilient metal sheet 73, such as copper, generally circular in shape and having a diameter less than the inner diameter of the shell 14 so that the outer periphery 74 of the plate is spaced from the inner wall of the shell. The plate contains a plurality of apertures 76 lying in a pattern corresponding to the pattern of the contact passages 26 in the insulator assembly 16 so that when the plate is mounted between the front and rear insulators, the apertures 26 are aligned with the contact passages. The diameter of each aperture 76 is about the same as or slightly greater than the diameter of the bore 40 in the rear insulator.

When the sheet 73 is initially formed, by etching or stamping, for example, a plurality (four being shown by way of example only) of tines or fingers 78 extend inwardly toward the center of each aperture 76. Such fingers are thereafter bent outwardly in one direction to form contact retention fingers 80. As best seen in FIG. 1, the fingers extend forwardly and inwardly from the edge of each aperture 76 into the rear section 56 of the bore 44 in the front insulator.

When a contact 12 is initially inserted into the insulator assembly 16, it will move forwardly until the enlargement 64 on the bushing 60 engages the resilient fingers 80 on the plate 58. Further forward movement of the contact in the passage 26 will cause the fingers 80 to deflect radially outwardly until the shoulder 68 on the bushing passes the end of the fingers, whereupon the fingers will spring inwardly to engage behind the shoulder thereby preventing rearward movement of the contact in the insulator. The front shoulder 66 on the bushing 60 and the tapered shoulder 72 on the contact body will engage the abutment surfaces 54 and 50, respectively, on the front insulator to prevent forward movement of the contact therein.

It will be noted that the diameter of the bore 40 is greater than the diameter of the rear termination end 36 of the contact body to provide a clearance space 82 therebetween. In order to remove the contact from the insulator assembly 16, a suitable tool (not shown) of hollow configuration is mounted over the rear of the contact body and inserted into the clearance space 82 until the forward end of the tool engages the fingers 80, thereby deflecting them radially outwardly behind the shoulder 68 on the bushing whereupon the contact, together with the tool mounted thereover, may be freely withdrawn from the rear of the insulator assembly. Thus, the contact retention assembly illustrated in FIGS. 1–3 is a rear contact insertion, rear contact release arrangement.

While the contact retention plate 58 has been described as being formed of metal, if desired it could be formed of plastic molded into the desired configuration so that the retention fingers 80 are resilient. The front and rear insulators may be bonded to the contact retention plate. Alternatively, the rear insulator could be removably mounted in the shell 14 so that the contact retention plate may be replaced in the event any of the fingers 80 become damaged during use. A retaining ring, such as indicated at 83 in FIG. 1, could be used to removably mount the insulator in the shell.

Figure 4:
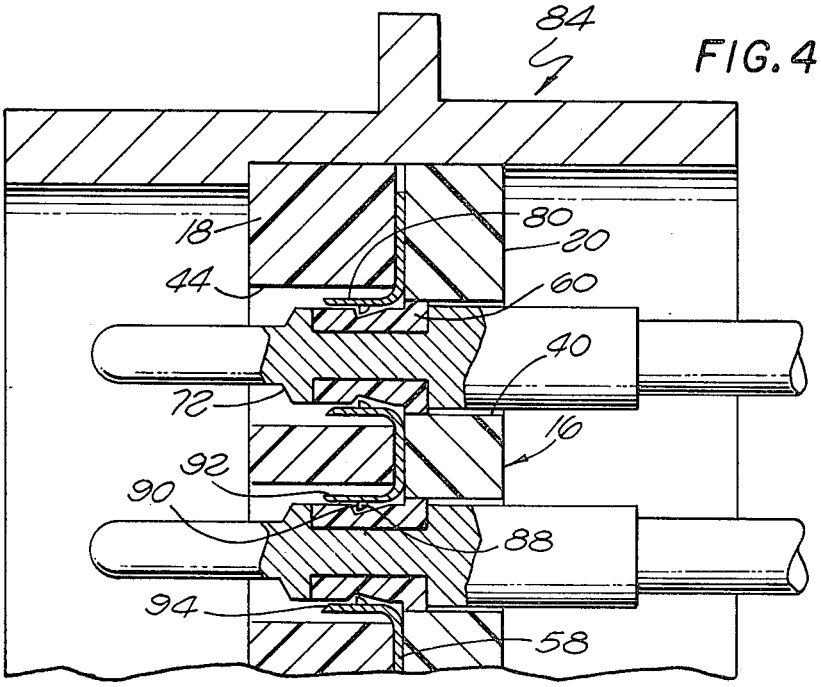
FIG. 4 is a fragmentary, partial longitudinal sectional view of a connector member incorporating a second embodiment of the contact retention assembly of the present invention.
Figure 5:
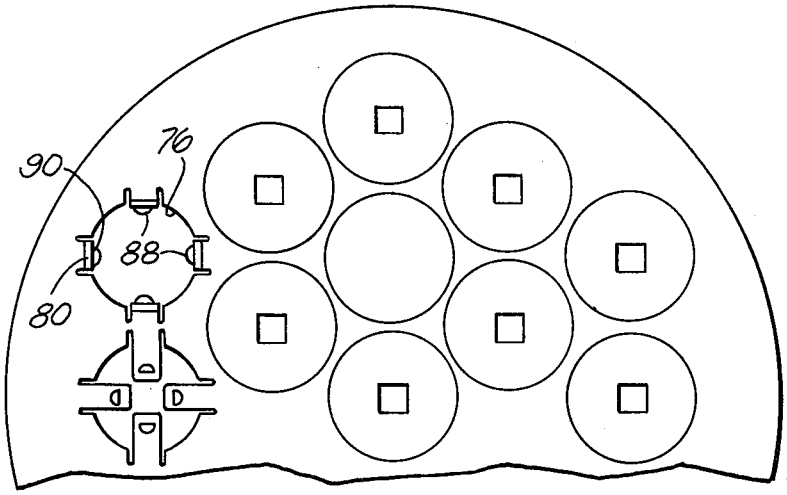
FIG. 5 is a fragmentary plan view of the contact retention plate illustrated in FIG. 4.
Figure 6:
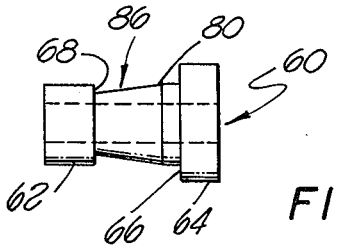
FIG. 6 is a side elevational view of the insulation sleeve utilized on the contacts illustrated in FIG. 4.

Reference is now made to FIGS. 4–6 of the drawings which illustrate an electrical connector member 84 embodying a rear contact insertion, front release contact retention assembly in accordance with the present invention. In this embodiment, the bore 44 in the front insulator 18 has a uniform diameter throughout its length, which diameter is greater than that of the bore 40 in the rear insulator 20. The bushing 60 on the contact in this embodiment is formed with its enlargement 64 at the rear end of the body 62 of the bushing. An annular recess 86 is formed in the body 60 in front of the enlargement 64. The recess is defined by a forwardly tapered surface 88 and a radially extending rearwardly facing annular shoulder 68. The retention fingers 80 on the contact retention plate 58 in FIGS. 4 and 5 are each formed with an inwardly extending projection 88 providing a forwardly facing stop surface 90 thereon. The diameter of the enlargement 64 on the bushing 60 in FIGS. 4 and 6 is slightly less than the diameter of the bore 40 in rear insulator 20, but greater than the diameter of the aperture 76 in the plate 58. When the contact is inserted into the insulator assembly 16 from the rear, the tapered shoulder 72 on the front of the contact will spread the fingers 80 outwardly until the projections 88 thereon enter into the recess 86 in the bushing whereupon the forwardly facing stop surfaces 90 on the projections will engage the radial shoulder 68 on the bushing thereby restricting rearward movement of the contact in the insulator assembly. The abutment surface 66 provided by the enlargement 64 on the bushing engages the area of the contact retention plate 58 surrounding the aperture 76 to restrict forward movement of the contact in the insulator. The forward end 92 of each retention finger 80 extends forwardly over the bushing in front of the recess 86, and embodies an internal beveled surface 94 which may be engaged by a tool inserted over the contact from the front of the connector to spread the fingers apart, thereby allowing removal of the contact from the rear of the connector.

Figure 7:
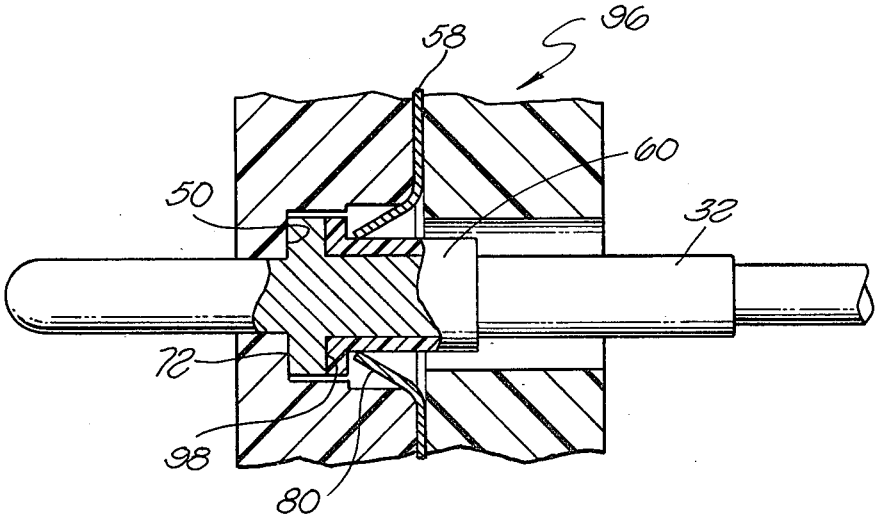
FIG. 7 is a fragmentary, partial longitudinal sectional view through a portion of a third embodiment of the contact retention assembly of the present invention.

FIG. 7 shows a further embodiment of the contact retention assembly of the present invention, generally designated 96, in which the insulative sleeve 60 is provided in the form of a coating which is adhered to a radially extending, rearwardly facing annular surface 98 on the contact and the cylindrical portion of the contact body 32 behind such surface. Forwardly facing annular shoulder 72 on the contact body 32 in front of the surface 98 engages rearwardly facing abutment surface 50 in the front insulator to restrict forward movement of the contact therein. The contact retention plate 58 may be identical to that illustrated in FIGS. 1 and 2. The retention fingers 80 on the plate engage the dielectric coating 60 on the contact. The coating may be a nonporous epoxy paint which is applied in sufficient thickness to provide the desired contact-to-contact electrical isolation. If desired, the dielectric coating 60 may be applied over the entire length of the contact body which lies within the front and rear insulators. However, applying the dielectric coating as shown in FIG. 7 minimizes the diameter of the contact thus leading to a higher density contact arrangement.

Figure 8:
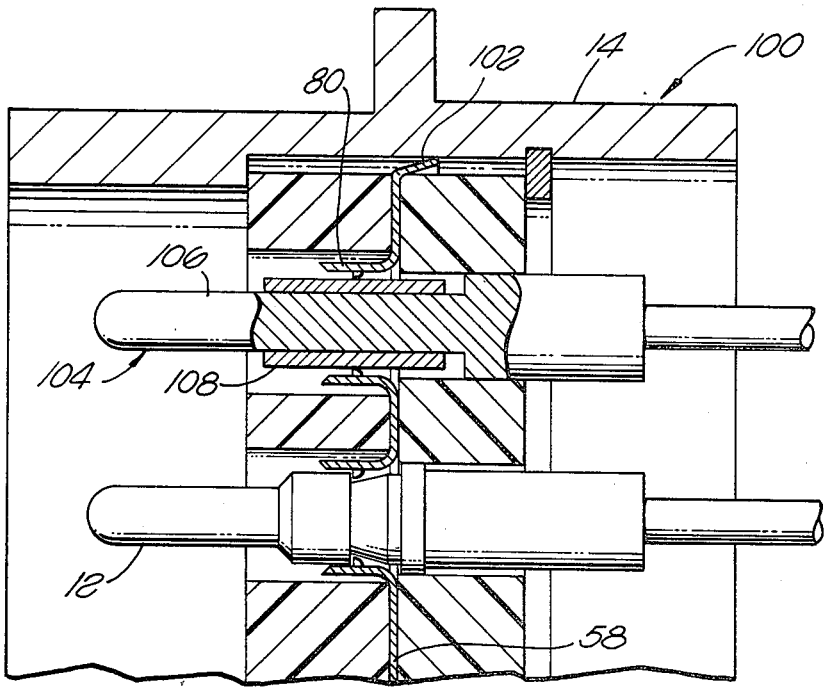
FIG. 8 is a fragmentary, partial longitudinal sectional view through still a further embodiment of the invention in which the retention plate also serves as a ground plane.
Figure 9:
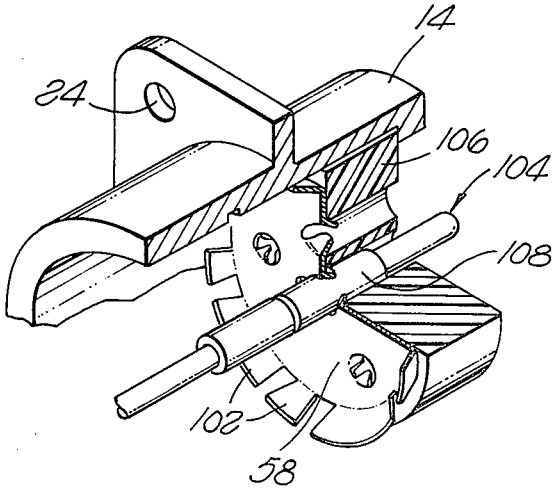
FIG. 9 is a fragmentary perspective view, partially in section, of the connector illustrated in FIG. 8 showing a filter contact mounted therein.

Reference is now made to FIGS. 8 and 9 of the drawings which show a connector member 100 similar to that shown in FIG. 4 except the contact retention plate 58 (which in this case must be conductive) is formed with outwardly extending spring tines 102 that resiliently engage the interior of shell 14 so that the plate can serve the additional function of a ground plane as in the aforementioned Peverill patent. The contact 12 in FIG. 8 may be identical to the contact illustrated in FIG. 4 wherein the contact body carries an insulative sleeve which electrically isolates the contact from the contact retention plate and ground plane 58 as well as enhances the contact-to-contact electrical isolation in the assembly. Alternatively, the contact 12 illustrated in FIG. 8 could be a ground contact in which the metallic body would have the configuration as shown, and, thus, exclude an insulative sleeve so that there is electrical connection between the contact to the shell of the connector member via the plate 58. The contact 104 shown in FIGS. 8 and 9 comprises a filter contact in which the contact body 106 carries an annular filter element 108 of a form well known in the art, such as disclosed in the aforementioned Peverill and Heyden patents. It will be noted that the spring fingers 80 of the retention plate surrounding the aperture in which the contact 104 is mounted engage the outer surface of the filter 108 thereby providing electrical connection between the filter via the plate 58 to shell 14.

From the foregoing, it will be appreciated that the plate 58 in FIGS. 8 and 9 serves the dual function of a contact retention plate and a ground plane. The connector permits a wide variety of electrical networks by the mixture of isolating contacts (those carrying insulative sleeves) with ground and filter contacts.

In summary, the novel contact retention assembly of the present invention permits a higher density contact arrangement in an electrical connector than heretofore permitted by connectors utilizing individual metal contact retention clips due to the increased degree of contact-to-contact electrical isolation provided by the insulative sleeves on the contact bodies. Furthermore, the contact retention plate of the invention may be assembled more rapidly and at less expense than a large number of individual metal contact retention clips as in the prior art connectors. The contacts in the connector may be removed by the use of standard contact insertion and removal tools. Finally, the connector permits the use of a mixture of isolating contacts with ground and filter contacts.

What is claimed is:

1. An electrical connector member comprising:
an insulator having a plurality of passages extending therethrough from a front face to a rear face thereof;
a contact retention plate extending transversely across said insulator substantially normal to the longitudinal axes of said passages;
said plate embodying apertures each aligned with a corresponding one of said passages;
a radially deflectable retention finger extending inwardly from the edge of each said aperture into its corresponding passage toward one of said faces; and
a contact in at least one of said passages having an insulative sleeve thereon formed with a shoulder directed toward the other of said faces and engaged by said finger whereby said finger restricts movement of said contact in the direction of said other face.

2. An electrical connector as set forth in claim 1 wherein:
said plate is formed of resilient metal.

3. An electrical connector as set forth in claim 1 wherein:
said plate is formed of a resilient insulative material.

4. An electrical connector as set forth in claim 1 wherein:
a plurality of said contacts is provided each mounted in one of said passages.

5. An electrical connector as set forth in claim 1 wherein:
said shoulder on said sleeve is annular; and
each said aperture is bordered by a plurality of said fingers engaging the annular shoulder of the sleeve on the contact passing through said aperture.

6. An electrical connector as set forth in claim 1 wherein:
said fingers extend forwardly toward said front face; and
said shoulder on said sleeve faces rearwardly.

7. An electrical connector as set forth in claim 1 wherein:
said contact comprises an elongated body having an annular groove therein; and
said sleeve comprises a separate bushing mounted in said groove.

8. An electrical connector as set forth in claim 7 wherein:
said bushing has an axial dimension slightly less than that of said groove so as to be restricted against axial movement on said body.

9. An electrical connector as set forth in claim 7 wherein:
said bushing embodies an enlargement providing said shoulder and a second forwardly facing shoulder;
said retention finger extends forwardly into said passage to engage said first-mentioned shoulder for restricting rearward movement of said contact in said passage; and
an annular abutment is formed in said passage engaged by said second shoulder restricting forward movement of said contact in said passage.

10. An electrical connector as set forth in claim 7 wherein:
said bushing embodies an annular recess providing said shoulder at the forward end thereof;
said retention finger projects forwardly into said passage, said finger having a forward end extending over said contact body in front of said recess and an inwardly extending projection spaced behind said forward end providing a forwardly facing stop surface engaging said shoulder for restricting rearward movement of said contact in said passage; and
said forward end of said finger is formed with an internal beveled surface.

11. An electrical connector as set forth in claim 10 wherein:
said bushing embodies an enlargement behind said recess defining a forwardly facing abutment surface engaging said plate for restricting forward movement of said contact in said passage.

12. An electrical connector as set forth in claim 1 wherein:
said sleeve comprises a heat-shrinkable plastic bushing.

13. An electrical connector as set forth in claim 1 wherein:
said sleeve comprises a dielectric coating adhered to said contact.

14. An electrical connector as set forth in claim 1 wherein:
said insulator is surrounded by a conductive shell; and
said plate is spaced from said shell.

15. An electrical connector as set forth in claim 1 wherein:
said insulator is surrounded by a conductive shell; and
said plate is formed of a conductive material and engages said shell.

16. An electrical connector as set forth in claim 15 wherein:
said plate embodies spring tines extending outwardly from its periphery resiliently engaging said shell.

17. An electrical connector as set forth in claim 15 wherein:
a ground contact is mounted in one of said passages; and
the retention finger of said plate associated with said passage directly engaging said ground contact.

18. An electrical connector as set forth in claim 15 wherein:
a filter contact is mounted in one of said passages; and
the retention finger of said plate associated with said passage engages the filter of said filter contact.

19. An electrical connector member comprising:

an insert having a plurality of passages extending therethrough from a front face to a rear face thereof;

a contact retention plate extending transversely across said insert substantially normal to the longitudinal axes of said passages;

said plate embodying apertures each aligned with a corresponding one of said passages;

a radially deflectable retention finger extending inwardly from the edge of each said aperture into its corresponding passage toward one of said faces; and a contact in at least one of said passages having insulative means thereon formed with a shoulder directed toward the other of said faces and engaged by said finger whereby said finger restricts movement of said contact in the direction of said other face.

20. An electrical connector member comprising:

a connector shell having a longitudinal axis therethrough;

a contact retention plate extending transversely across said shell substantially normal to said longitudinal axis;

said plate embodying a plurlity of apertures;

a radially deflectable retention finger extending inwardly from the edge of each said aperture toward one end of said shell; and a contact in at least one of said apertures having insulative means thereon formed with a shoulder directed toward the other end of said shell and engaged by said finger whereby said finger restricts movement of said contact in the direction of said other end.

21. An electrical connector as set forth in claim 20 wherein:

said plate is formed of resilient metal.

* * * * *